United States Patent [19]

Todokoro

[11] Patent Number: 4,778,429

[45] Date of Patent: Oct. 18, 1988

[54] TOY FOR DABBLING

[75] Inventor: Masatoshi Todokoro, Tokyo, Japan

[73] Assignee: Staff Co., Ltd., Tokyo, Japan

[21] Appl. No.: 138,333

[22] Filed: Dec. 28, 1987

[51] Int. Cl.[4] ..... A63H 23/00; A63H 33/22

[52] U.S. Cl. ..... 446/153; 446/198; 446/219; 446/217; 446/431

[58] Field of Search ..... 446/153, 154, 198, 197, 446/180, 219, 217, 267, 431, 227, 166; 273/58 K, 58 F

[56] References Cited

U.S. PATENT DOCUMENTS

| | | | |
|---|---|---|---|
| 1,337,758 | 4/1920 | De Costa | 446/153 |
| 3,603,023 | 9/1971 | McHugh | 446/431 |
| 3,693,281 | 9/1972 | Wolf | 446/219 X |
| 4,223,471 | 9/1980 | Greenberg | 446/198 |
| 4,645,471 | 2/1987 | Herring et al. | 446/431 X |

FOREIGN PATENT DOCUMENTS

| | | | |
|---|---|---|---|
| 723520 | 4/1932 | France | 446/267 |

*Primary Examiner*—Mickey Yu

*Attorney, Agent, or Firm*—George B. Oujevolk

[57] ABSTRACT

A toy for dabbling, having a toy body; a cylinder extending from one side portion of the toy body to the opposite portion thereof and supported fixedly therein; a fish bowl in which a smaller imitation fish is to swim, an imitation windmill, a larger imitation fish connected to a thread, a pump, and an ejection nozzle joined to the pump, all of which are fitted in different portions of the wall of the toy body; a reel which is urged so that the thread is constantly taken up therearound, and which is secured to the portion of the wall of the toy body in which the larger imitation fish is fitted; a lens or a transparent plate fitted in one end of the cylinder; and a cover having a plurality of air vents and fixed to the other end of the cylinder.

5 Claims, 5 Drawing Sheets

TOY FOR DABBLING

BACKGROUND OF THE INVENTION 1. (Field of the Invention)

This invention relates to a toy for dabbling, and more particularly to a toy which children put in the water and play with.

2. (Prior Art)

Most of the conventional toys for dabbling are used as they are floated simply on the surface of the hot water in a bathtub or the surface of the cold water stored in a tank or some other kind of vessel.

These conventional toys for dabbling can provide only a monotonous way of playing, and are lacking in interest.

(Object of the Invention)

A first object of the present invention is to provide a very interesting toy for dabbling.

A second object of the present invention is to provide a toy having a single toy body and capable of playing at observing fish in an aquarium, turning a windmill, fishing, shooting with a water pistol, observing fish and plants through underwaterglass, forming bubbles and sprinkling water through a funnel.

These objects and features of the invention will be understood more clearly when the following statement is considered with reference to the accompanying drawings which illustrate an embodiment of the present invention.

BRIEF DESCRIPTION OF THE DRAWINGS

The accompanying drawings show an embodiment of the present invention, wherein.

DETAILED DESCRIPTION OF THE INVENTION

Figure 1:
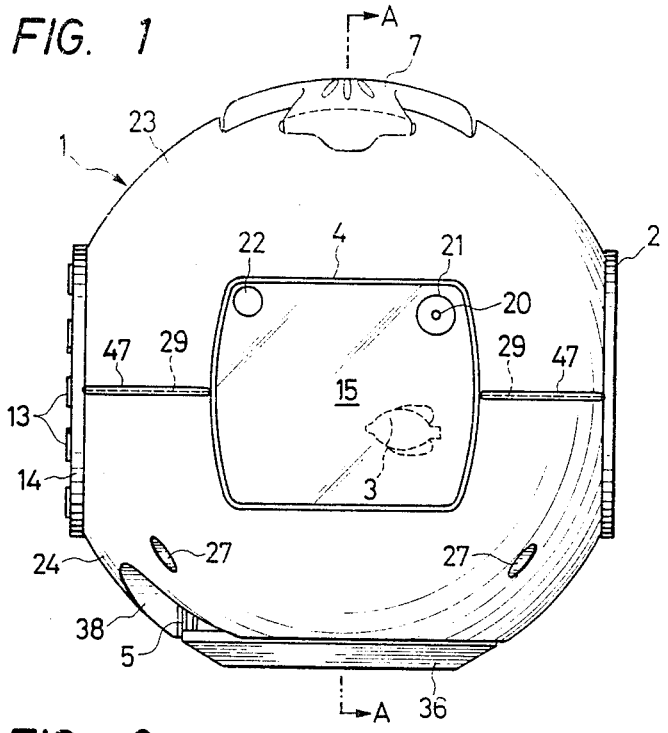
FIG. 1 is a side elevation of a fish bowl side portion of a toy for dabbling.
Figure 2:
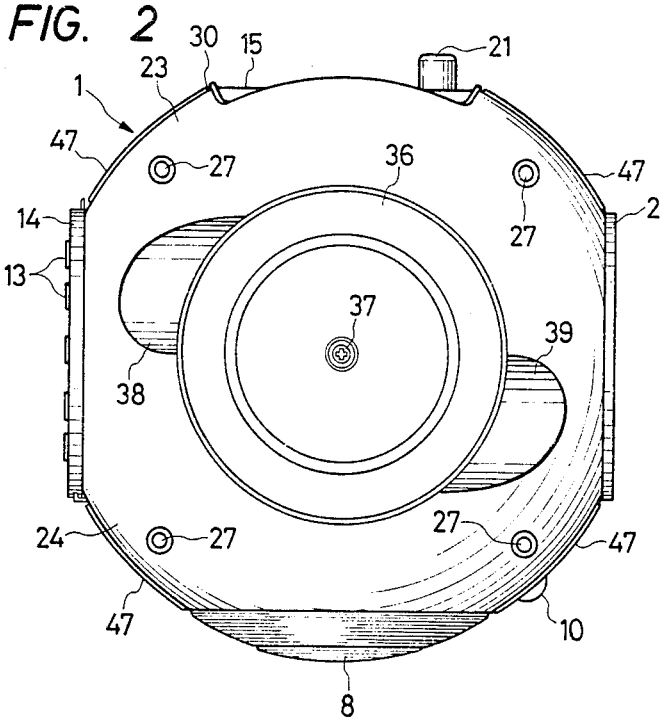
FIG. 2 is a side elevation of a windmill side portion of the toy for dabbling.
Figure 3:
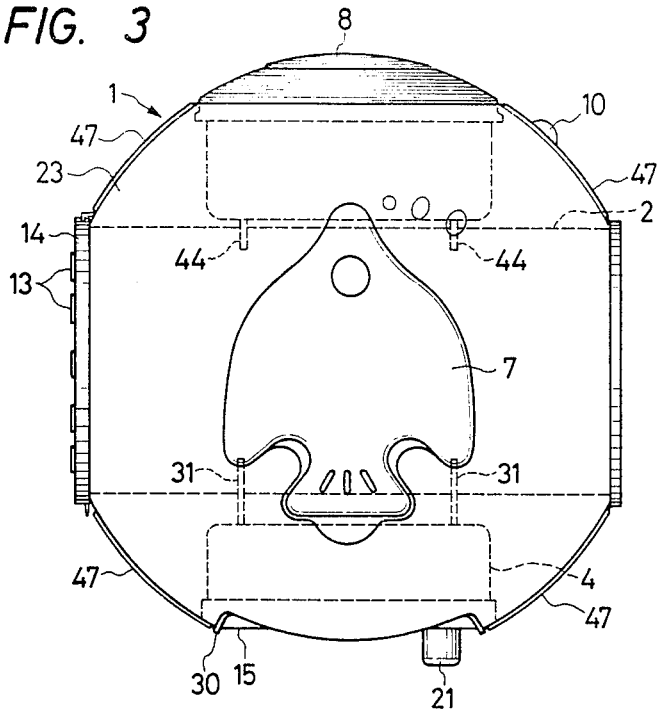
FIG. 3 is a side elevation of an imitation fish side portion of the toy for dabbling.
Figure 4:
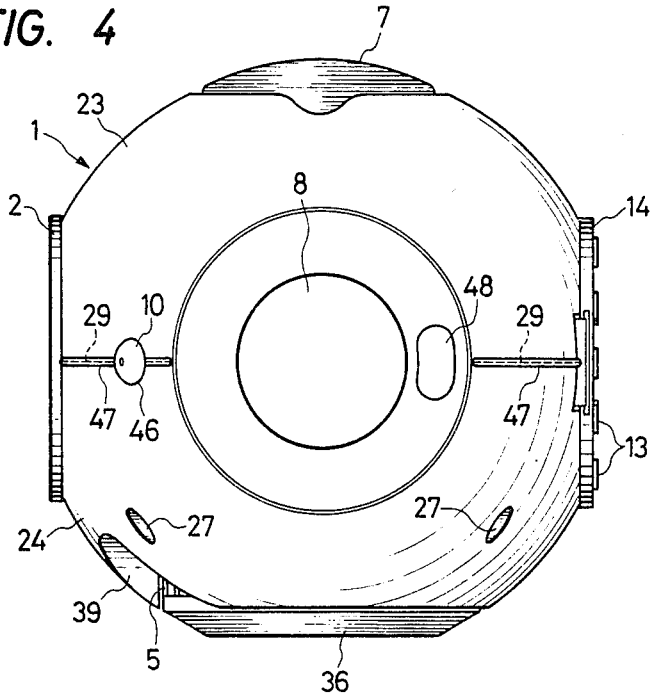
FIG. 4 is a side elevation of pump body side portion of the toy for dabbling.
Figure 5:
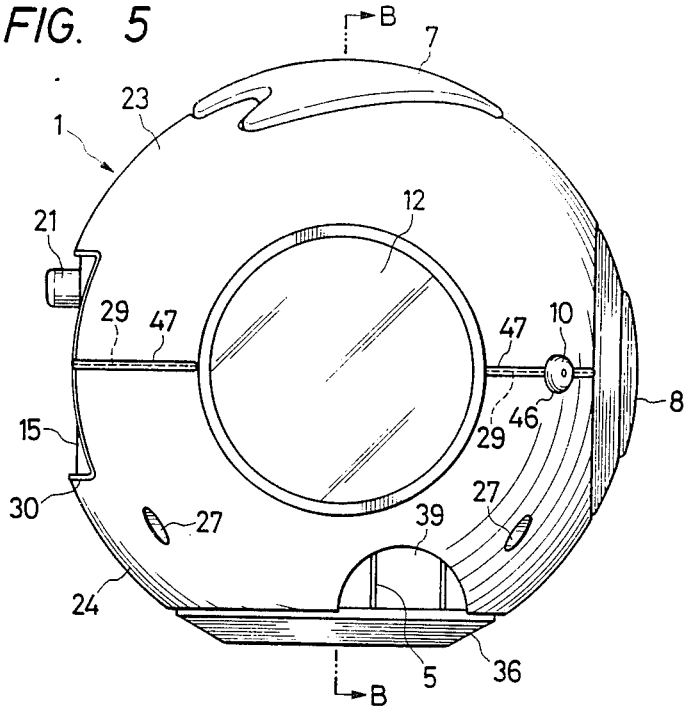
FIG. 5 is a side elevation of a lens side portion of the toy for dabbling.
Figure 6:
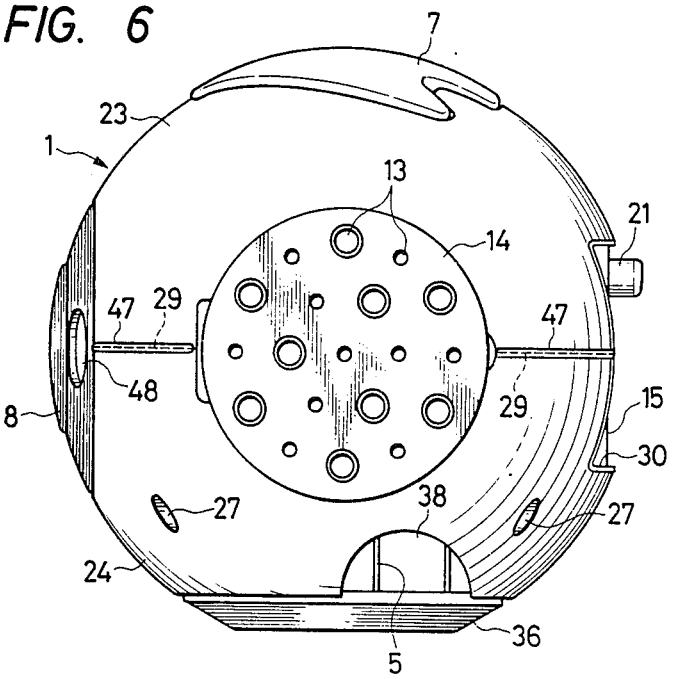
FIG. 6 is a side elevation of a cover side portion of the toy for dabbling.
Figure 7:
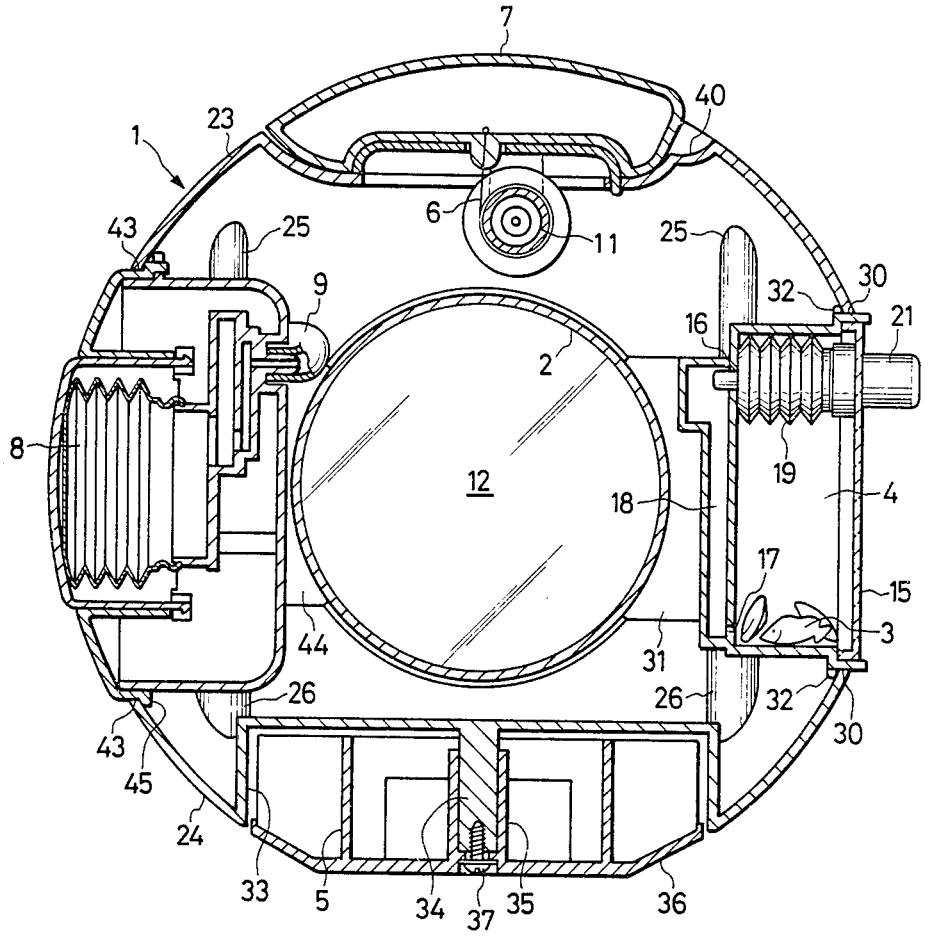
FIG. 7 is an enlarged sectional view taken along the line A—A in FIG. 1.
Figure 8:
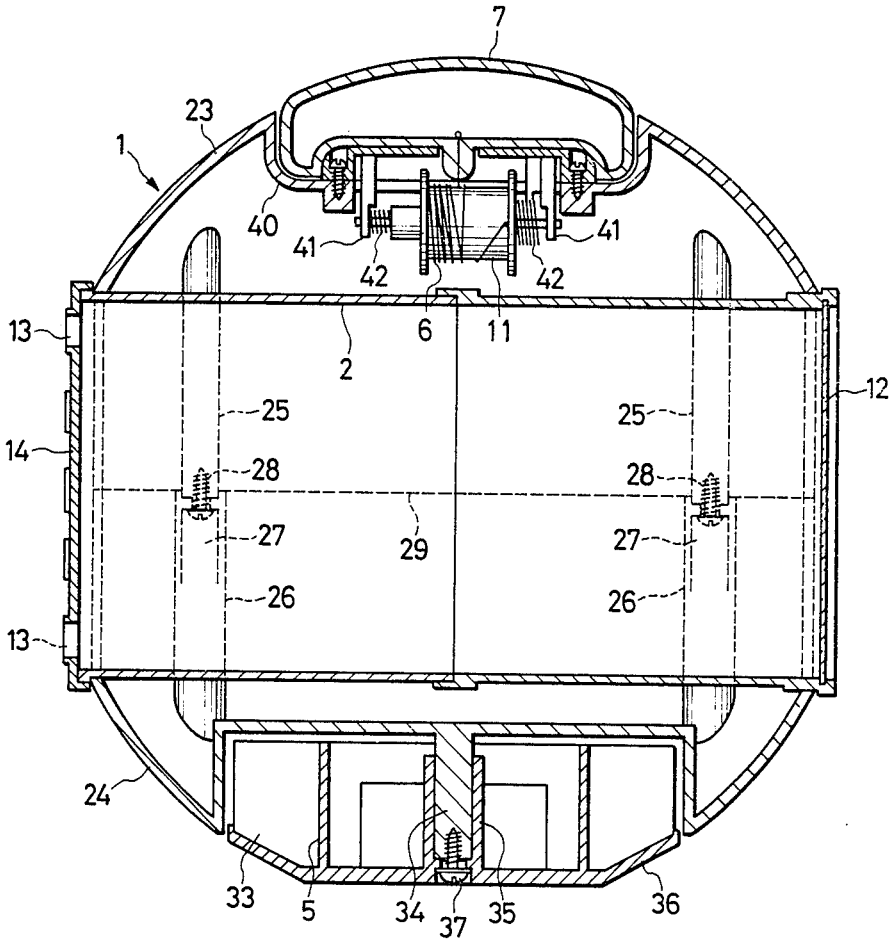
FIG. 8 is an enlarged sectional view taken along the line B—B in FIG. 5.

The present invention will now be described in detail with reference to the drawings. Reference numeral 1 denotes a spherical toy body having a cylinder 2 extending from one side portion thereof to the opposite side portion thereof and fixedly supported. A fish bowl 4 in which an imitation fish 3 is to swim, an imitation windmill 5, an imitation fish 7 connected to a thread 6, an imitation pump 8, and an ejection nozzle 10 joined to the pump 8 via a pipe 9 are fitted in the wall of the toy body 1. A reel 11 urged so that the thread 6 is constantly taken up therearound is secured to the portion of the wall of the toy body 1 in which the imitation fish 7 is fitted. A lens or a transparent plate 12 is fitted in one end of the cylinder 2, and a cover 14 having a plurality of air vents 13 are fixed to the other end thereof so that the cover 14 can be opened and closed. The portion of the fish bowl 4 which is on the side of the outer surface of the toy body 1 is covered with a transparent plate 15. The fish bowl 4 is provided on the outer side thereof with an air passage 18 which is communicated with air holes 16, 17 provided in two inner portions of the fish bowl 4. In the fish bowl 4, bellows 19 communicated with one air hole 16 is provided. A knob 21 projecting outward from the transparent plate 15 and having a port 50 communicated with the interior of the bellows 19 is joined to the same bellows 19. A water inlet 22 is provided in a predetermined portion of the periphery of the transparent plate 15, and a suitable number of imitation fishes having a buoyancy high enough to float them in a position of an arbitrary depth of water are placed in the fish bowl 4.

OPERATION

When the water is injected from the water inlet 22 into the fish bowl 4, or when the toy body 1 is submerged in the water to introduce the water from the water inlet 22 into the fish bowl 4, the imitation fishes 3 float to a position of an arbitrary depth of water therein. When the knob 21 is then pressed inward, the bellows 19 are compressed, so that the air in the bellows 19 is sent to the air passage 18 through the air hole 16. Consequently, the air is ejected in the form of bubbles from the air hole 17 into the fish bowl 4 to agitate the water therein. During this time, the swimming of the imitation fishes 3 in the fish bowl 4 can be seen through the transparent plate 15. When the water is poured over the windmill 5, it turns as it is left fitted in the wall of the toy body 1. When the imitation fish 7 is removed from the outer surface of the toy body 1 and moved away therefrom, the thread 6 is drawn out. When the imitation fish 7 is then released from the hand, the thread 6 is taken up around the reel 11 automatically, so that the imitation fish 7 is also drawn to the outer surface of the toy body 1. The water is poured into the pump 8, or the toy body 1 is submerged in the water to introduce the water into the pump 8. When the pump 8 is then pressed, the water is ejected from the ejection nozzle 10, i.e., the toy operates like a pistol. The toy body 1 is floated on the surface of the water with the lens or transparent plate 12 positioned on the lower side of the toy body 1, and the cover 14 is opened to peep through the cylinder 2. As a result, the things under water can be seen on an enlarged scale through the lens or transparent plate 12. When the toy body 1 is submerged in the water with the cover 14 closed and positioned on the upper side of the toy body 1, bubbles are sent out from the air vents 13 in the cover 14 into the water, and the water enters the cylinder 2 at the same time. When the toy body 1 is pulled up from the water after the water has entered the cylinder 2, to then turn the toy body 1 so that the cover 14 is positioned on the lower side thereof, the water in the cylinder 2 flows out from the air vents 13 at once like the water flowing out from a funnel.

EMBODIMENT

The toy body 1 is assembled by abutting two hemispherically molded divisional members 23, 24 on each other, engaging the free end portions of projections 25, which extend from a plurality of portions of the inner surface of one divisional member 23, with those of projections 26, which extend from a plurality of corresponding portions of the inner surface of the other divisional member 24, inserting screws 28 into bores 27 which extend from the free end portions of the projections 26 to the outer surface of the toy body 1, and driving these screws 28 into the free end portions of the projections 25 to combine the divisional members 23, 24 unitarily. The fish bowl 4 is fitted in the interior of the toy body 1 from recesses 30, which extend symmetrically from a contact surface 30 between the divisional members 23, 24 in the opposite directions into the walls of the divisional members 23, 24, and it is fixed to the toy body 1 with the free arcuate edges of a pair of legs 31, 31, which extend from the rear surface of the fish bowl 4, engaged with the side surface of the cylinder 2, and with projections 32, which extend from a plurality of portions of the side surfaces of the fish bowl 4, engaged under pressure with the edge portions of the recesses 30. The imitation windmill 5 is placed in a recess 33 made circularly in the top portion of the divisional member 23, and a shaft 35 provided in the central portion of the imitation windmill 5 is fitted rotatably around a shaft 34 projecting from the central portion of the bottom surface of the recess 33. An umbrella type cover 36 enclosing the whole of the opening of the recess 33 is provided, and a screw 37 is driven from the central portion of the umbrella type cover 36 into the free end portion of the shaft 34 so as to prevent the imitation windmill 5 from slipping out from the recess 33. When the water is introduced from either one of water channels 38, 39, which are made so as to extend from the opposite portions of the inner surface of the recess 33 to the outer surface of the divisional member 23, into the recess 33 so that the water is discharged into the other water channel, the imitation windmill 5 is rotated. The imitation fish 7 is fitted detachably in a recess 40 which is formed by sinking the top portion of the divisional member 24 so that the contour of the recess 40 is in conformity with that of the imitation fish 7. Support members 41 rotatably supporting the reel 11 are secured to the central portion of the recess 40, and the reel 11 is provided with springs 42 which urges the reel 11 so as to always take up the thread 6, which are connected between the reel 11 and the imitation fish 7, around the reel 11. The pump 8 is fitted in the interior of the toy body 1 from recesses 43 which are provided at the portion of the toy body 1 which is on the opposite side of the fish bowl 4, and which extend symmetrically from a contact surface 29 between the divisional members 23, 24 in the opposite directions into the walls of the divisional members 23, 24, and it is fixed to the toy body 1 with the free arcuate edges of a pair of legs 44, 44, which project from the rear surface of the pump 8, engaged with the side surface of the cylinder 2, and with flanges 45, which project from the side surfaces of the pump 8, engaged under pressure with the edges of the recesses 43. The ejection nozzle 10 is held in recesses 46 which are made in the portions of the divisional members 23, 24 which are in the vicinity of the pump 8, in such a manner that the recesses 46 extend symmetrically from the contact surface 29 between the divisional members 23, 24 in the opposite directions. The abutted edge of either one of the divisional members 23, 24 is provided with an edging 47 projecting so as to hide the contact surface 29 between the divisional members 23, 24. Reference numeral 48 denotes an inlet into which the water flows into the pump 8.

The toy for dabbling consisting of the above-described parts is molded so that it has weight small enough to enable the toy as a whole to float on the surface of the water. It may be put in the hot water in use in a bathtub, and a child may play therewith. A child may put this toy in the cold water or hot water stored in any other kind of container or place and play therewith. A toy body 1 molded to a shape other than a spherical shape is also used in some cases.

What is claimed is:

1. A toy for dabbling, comprising a toy body having an outer wall; a cylinder extending from one side portion of said toy body to an opposite portion thereof and supported fixedly therein; a fish bowl in which a small imitation fish is to swim, an imitation windmill, a larger imitation fish connected to a thread, a pump, and an ejection nozzle joined to said pump, all of which are fitted in different portions of the wall of said toy body; a reel which is urged so that said thread is constantly taken up therearound, and which is rotatably secured to the portion of the wall of said toy body in which said larger imitation fish is fitted; a lens or a transparent plate fitted in one end of said cylinder; and a cover having a plurality of air vents and fixed to the other end of said cylinder.

2. A toy for dabbling according to claim 1, wherein said toy body is molded spherically.

3. A toy for dabbling according to claim 1, wherein said fish bowl consists of a transparent plate forming an outer portion of the wall of said toy body, an air passage provided on a wall of said fish bowl and communicated with air holes provided in said wall of said fish bowl, bellows provided in said fish bowl and communicated with one of said air holes, a knob joined to said bellows so as to project outward from said transparent plate and having a port communicataed with the interior of said bellows, a water inlet provided in a predetermined portion of said transparent plate, and a suitable number of imitation fishes placed in said fish bowl and having a buoyancy high enough to float them in a position of an arbitrary depth of water therein.

4. A toy for dabbling according to claim 1, wherein said imitation windmill is placed in a recess opening made circularly in the wall of said toy body forming opposing inner surfaces and a bottom surface, said imitation windmill being provided at the central portion thereof with a shaft which is fitted rotatably around a shaft projecting from the central portion of the bottom surface of said recess, an umbrella type cover enclosing the whole of the opening of said recess a screw being driven from the central portion of said umbrella type cover into the free end portion of said shaft which extend from said recess, water channels being provided, which are made so as to extend from the opposite portions of the inner surface of said recess to the outer surface of said toy body.

5. A toy for dabbling according to claim 1, wherein a cover having a plurality of air vents are fixed to an end of said cylinder so that said cover can be opened and closed.

* * * * *